US005400629A

United States Patent [19]

Myers

[11] Patent Number: 5,400,629

[45] Date of Patent: Mar. 28, 1995

[54] AXIAL PIN TUMBLER LOCK

[75] Inventor: Gary L. Myers, River Grove, Ill.

[73] Assignee: Fort Lock Corporation, River Grove, Ill.

[21] Appl. No.: 84,299

[22] Filed: Jun. 28, 1993

Related U.S. Application Data

[63] Continuation-in-part of Ser. No. 891,783, Jun. 1, 1992, abandoned.

[51] Int. Cl.[6] ..... E05B 19/02; E05B 27/08

[52] U.S. Cl. ..... 70/491; 70/373; 70/375; 70/419

[58] Field of Search ..... 70/490, 491, 351, 360, 70/404, 496, 391, 392, 373, 375, 372, 367, 357, 419, 421

[56] References Cited

U.S. PATENT DOCUMENTS

| | | | |
|---|---|---|---|
| 1,842,182 | 1/1932 | Lindsay | 70/222 |
| 2,170,205 | 8/1939 | Lombardo | 70/491 |
| 2,391,834 | 12/1945 | Johnstone | 70/491 |
| 4,078,406 | 3/1978 | Genakis | 70/419 |
| 4,111,020 | 9/1978 | Scherbing | 70/491 |
| 4,228,668 | 10/1980 | Scherbing | 70/491 |
| 4,546,629 | 10/1985 | Hwang | 70/491 |
| 4,621,510 | 11/1986 | Scherbing | 70/491 |
| 5,024,072 | 6/1991 | Lee | 70/491 |
| 5,133,203 | 7/1992 | Huang | 70/360 |
| 5,327,752 | 7/1994 | Myers et al. | 70/58 |

*Primary Examiner*—Peter M. Cuomo
*Assistant Examiner*—Darnell M. Boucher
*Attorney, Agent, or Firm*—Leydig, Voit & Mayer Ltd.

[57] ABSTRACT

An axial pin tumbler lock for housing in an outer shell. The lock includes a shell and a rotatable driver sleeve telescoped into the shell. The driver sleeve has a birdcage design including a front large inner diameter portion and a rear small-diameter inner portion and circumferentially arranged throughbores in communication with the inner diameters. A stationary tumbler sleeve is also telescoped in the shell, and in a facing relationship with the driver sleeve. The tumbler sleeve slot includes throughbores in communication with an inner diameter. A spindle extends through the sleeves and is rotatably mounted in the driver sleeve. The spindle includes a body portion and a neck portion with a curved transition zone between the two. Driver and tumbler pins mounted in the throughbores normally prevent rotation of the spindle and driver sleeve with respect to the tumbler sleeve.

15 Claims, 3 Drawing Sheets

AXIAL PIN TUMBLER LOCK

RELATED APPLICATIONS

This application is a continuation-in-part of my co-pending application Ser. No. 07/891,783 filed Jun. 1, 1992 entitled "Computer Equipment Lock" now abandoned.

FIELD OF THE INVENTION

The invention relates generally to locking devices, and particularly to an improved axial pin tumbler lock.

BACKGROUND OF THE INVENTION

Axial pin tumbler locks are well-known in the art. However, they have had many disadvantages in terms of manufacturing cost and quality. Thus, while the use and design of axial pin tumbler locks is advantageous, it will be desirable to have a lock design having lower costs of manufacturing and construction.

Axial pin tumbler locks often suffer from the disadvantage of having large profiles. Since the axial pin tumblers in a typical lock are disposed within milled cylindrical holes in annular sleeves, the width of the annular sleeves must be sufficient to allow wall support around the entire circumference of these cylindrical holes. This leads to unnecessary thickness and bulkiness of the sleeves, and also causes them to have a greater outer diameter than would otherwise be necessary. The inner diameter must be smaller for the same reason. As a result, the central spindle of the lock must also have a smaller diameter, which means it will have less strength to endure both radial force and withdrawing force caused by tampering. It would thus be desirable to have annular sleeves with smaller thicknesses and smaller outer diameters so that the overall profile of the lock could be reduced, without losing security or performance.

The previously used design of axial pin tumbler locks has also been disadvantageous where die casting of the parts is generally used. Die casting has the nominal advantage of being less expensive than other metal forming techniques. However, the limitations in the die casting process allow only weaker alloys of metal to be used in such a process. As a result, the resulting components are weaker than they otherwise could be by virtue of other casting processes. Further, die casting does not allow for the most accurate tolerances. The ability to use other casting processes which would allow for harder parts and better tolerances would thus be desirable. Components with better tolerances in casting could be designed for tighter fit, and thus add to any reduction in overall profile of the lock. Die casting also does not allow parts to be cast with internal openings, as are required in conventional axial pin tumbler locks. As a result additional working of parts after casting is required. This leads to weakening of the components and significant added cost.

Axial pin tumbler locks also suffer from the disadvantage of being susceptible to uncoding of the pins by means of slippage of one of the annular sleeves with respect to the other when the lock is between the locked and unlocked positions. As will be discussed in further detail below, uncoding of an axial pin tumbler lock can occur when the sets of cylindrical holes on the respective annular sleeves are slightly misaligned when the key is withdrawn. Because of this misalignment, the tumbler pins do not extend beyond the plane separating the annular sleeves, and the annular sleeves are not locked in place so as to prevent relative rotational motion. In such a situation, the rotating cylindrical sleeve can rotate either direction to a misaligned position, thus allowing the tumbler pins to cross the plane between the sleeves, albeit into improper cylindrical holes. After this occurs, insertion of a properly-coded key does not cause the line of separation of the tumbler and driver pins to be co-planar with the separating plane between the sleeves. That is, insertion of the key does not unlock the lock. Such uncoding of axial pin tumbler locks is common, and requires full disassembly of the lock to correct. It would thus be desirable to have an axial pin tumbler lock which had provision for preventing such slippage.

SUMMARY OF THE INVENTION

It is the general aim of the present invention to provide an improved axial pin tumbler lock which is easily operated and low in cost to manufacture and assemble.

In accordance with that aim, it is an object of the present invention to provide an axial pin tumbler lock having a smaller profile or diameter than conventional locks.

It is a related object of the invention to provide annular sleeves within an axial pin tumbler lock that have a smaller radial thickness, and smaller outer diameter than cylindrical sleeves in conventional locks.

It is a further related object of the invention to provide a unique design for the annular sleeves that allows for the smaller thickness and diameter.

It is a still further related object to provide a design for the annular sleeves that allows for a larger diameter of the central lock spindle.

It is a further object of the invention to provide an axial pin tumbler lock, the components of which have increased hardness and better tolerances.

It is a related object of the invention to provide for manufacture of the components of an axial pin tumbler lock by means of investment casting.

It is a further related object to provide for cast components which do not require additional working after casting.

It is a further object of the present invention to provide an axial pin tumbler lock that prevents uncoding of the lock by means of slippage.

It is a related object of the invention to prevent such slippage without undue obstruction of the internal components of the lock.

In accordance with these and other objects of the invention, there is provided an axial pin tumbler lock having a unique design and including the features of a smaller profile as provided by annular sleeves having a bird-cage design. The components of the axial pin tumbler lock are designed so that they can be manufactured by means of investment casting, giving greater strength and better tolerances to those components and reducing the need for working after casting. Further, the axial pin tumbler lock according to the present invention also includes anti-slip means that prevent accidental un-coding of the lock. When the lock according to the present invention needs to be biased toward the object being secured, it also includes a novel support plate having a splined configuration to support the plate against the shell of the lock.

Overall, the lock according to the present invention offers a significant advantage over existing axial pin tumbler locks. It has a lower profile, is made of stronger materials with higher tolerances, is not subject to slip, and is generally inexpensive to manufacture and easy to assemble.

DETAILED DESCRIPTION OF THE PREFERRED EMBODIMENTS

Figure 1:
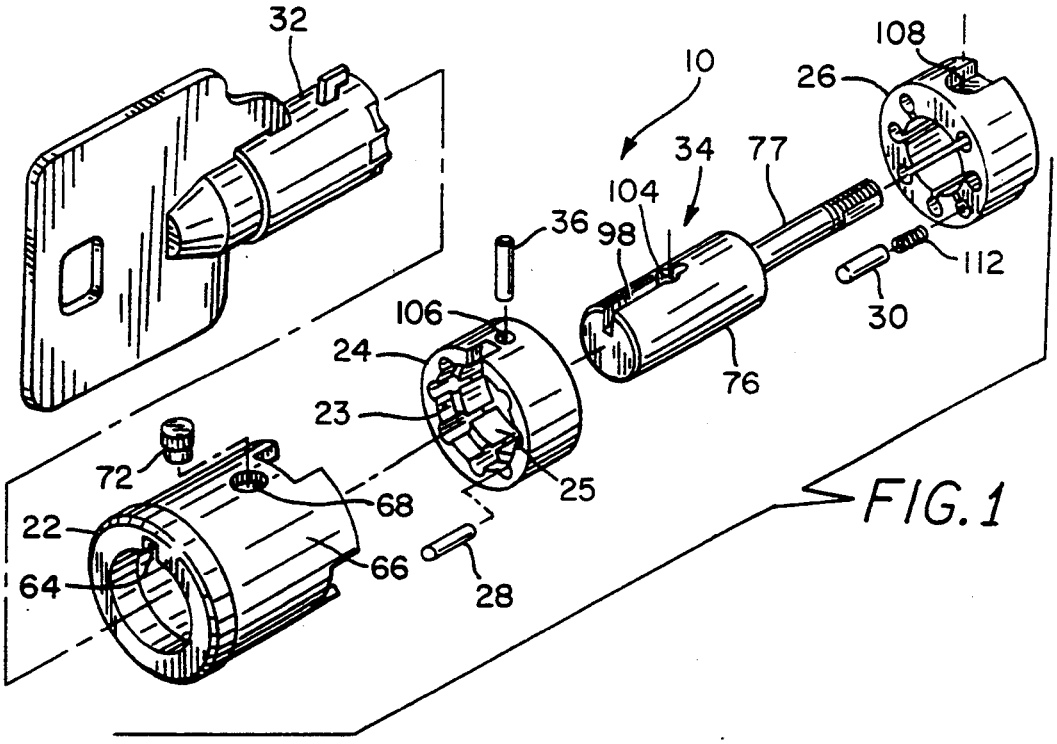
FIG. 1 is an exploded perspective view of the axial pin tumbler lock according to the preferred embodiment of the present invention.
Figure 2:
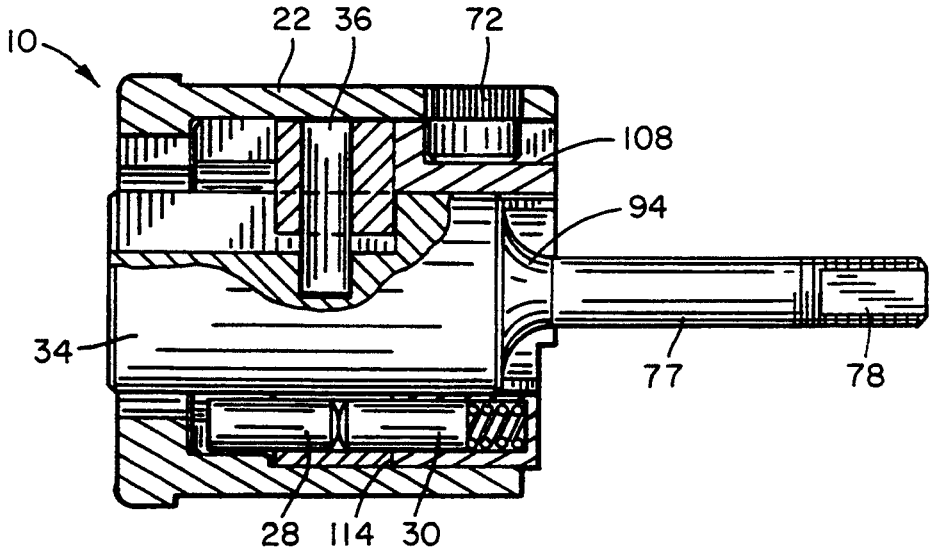
FIG. 2 is a sectional side view of the axial pin tumbler lock according to the present invention.

Referring now to FIGS. 1 and 2, an axial pin tumbler lock 10 according to the preferred embodiment of the present invention is shown in exploded view in FIG. 1, and in cross-section in FIG. 2. The lock 10 includes a shell 22 as best seen by reference to FIG. 1. Telescoped within the shell 22 is a rotatable driver sleeve 24. In the assembled state, the rotatable driver sleeve 24 is disposed in face-to-face relation with a non-rotatable tumbler sleeve 26. As will be discussed more fully below, the rotatable driver sleeve 24 houses a multiplicity of driver pins 28 which cooperatively depress spring biased tumbler pins 30 housed within the non-rotatable tumbler sleeve 26 upon insertion of a proper key member 32, thereby permitting relative rotation of driver sleeve 24 with respect to non-rotatable tumbler sleeve 26. Extending through sleeves 24, 26 is a locking spindle 34, described in greater detail below. As also described more fully below, connecting means 36 are disposed between rotatable driver sleeve 24 and locking spindle 34, thereby serving to transmit the rotational movement of driver sleeve 24 to the spindle 34.

The shell 22 is shown most clearly in FIG. 1. The forward face of the shell 22 has a substantially circular perimeter with indent means 64 for properly aligning and guiding key 32 into contacting relation with the driver pins 28. The body portion 66 of the shell 22 is of a substantially cylindrical configuration. As shown, a borehole 68 is disposed within shell 22 for accepting a retaining pin 72. The retaining pin 72 secures shell 22 to non-rotatable tumbler sleeve 26 by engaging the slot 108 in sleeve 26. This engagement of pin 72 with slot 108 both ensures that non-rotatable sleeve 26 is held in a constant angular position while also allowing sleeve 26 to slide back and forth with respect to shell 22, and thus with respect to spindle 34. Shell 22 may optionally be disposed within a cylindrical casing.

In a preferred embodiment of the present invention, the spindle 34 will comprise a body portion 76, a neck portion 77 and an actuation portion 78. The actuation portion 78 will preferably be a cam-receiving portion having a double-D configuration, and include threading for receipt of an actuating cam and bolt. With a cam thus secured to the spindle 34, the lock is adapted so that the spindle 34 and associated cam rotate between a locked position and an unlocked position upon insertion of a properly-coded key.

Figure 3:
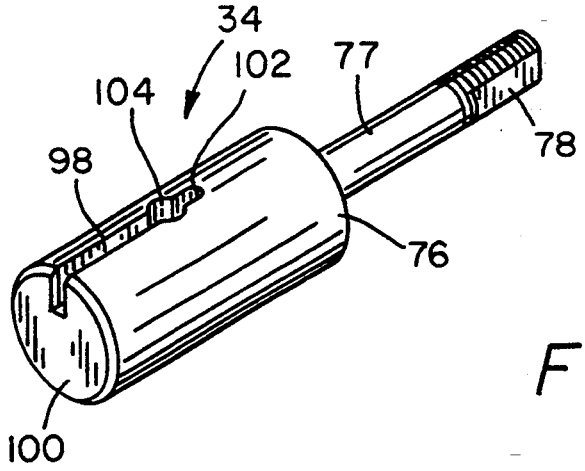
FIG. 3 is an isolated perspective view of a locking spindle for use in the axial pin tumbler lock of the present invention.

The preferred embodiment of the spindle for use in the lock of the present invention is shown in FIG. 3. As illustrated, the spindle includes a substantially cylindrical body portion 76 and a substantially cylindrical neck portion 77 having a diameter which is less than that of the body portion 76. As previously indicated, actuation portion 78 is disposed at the end of neck portion 77. With regard to one important aspect of the present invention, the spindle 34 is provided with a gradual rounded transition zone 94 as can best be seen in FIG. 2. As will be recognized, the use of such a rounded transition zone reduces the potential for a spindle failure since the forces applied to the spindle are distributed across a broad surface, thus avoiding the concentration of forces at one location. Conversely, spindles utilized in the past have often incorporated sharp-edged transition zones, leading to the potential for catastrophic failure at high energy surfaces such as corners and the like. Further, the spindle 34 according to the present invention also differs from previous spindles in that it is formed by means of investment casting. Use of investment casting allows higher-strength alloys than die casting, and also allows for greater tolerances in forming the spindle 34. The strength of spindle 34 is larger than in previous spindles since it has a larger diameter relative to the diameter of sleeves 24, 26. This is the result of the smaller thickness and outer diameters of the sleeves 24, 26 as provided by their design according to the present invention.

To ensure rotation of the spindle 34 with the rotatable driver sleeve 24, spindle 34 is provided with a groove 98 extending from the forward face 100 of the spindle to a point 102 forward of the neck portion 77. Groove 98 cooperatively engages a detent means 96 of the driver sleeve 24, shown most clearly if FIGS. 6 and 7. Accordingly, when the spindle 34 and the driver sleeve 24 are in engagement, rotational motion of driver sleeve 24 is transmitted to spindle 34, and relative axial movement is restricted by the length of the groove 98. The groove 98 of spindle 34 is of substantial uniform depth over its entire length except for a depressed bore 104. As previously indicated, the driver sleeve 24 and the spindle 34 are attached by connecting pin 36 illustrated in FIGS. 1 and 2. The connecting pin 36 is inserted through driver sleeve borehole 106 and into depressed bore 104 located in groove 98. As will be appreciated by the those skilled in the art, the placement of depressed bore 104 within groove 98 enhances the ease of assembly. That is, the spindle 34 and driver sleeve are allowed relative axial movement when detent 96 is simply engaged within groove 98. However, upon application of pin 36 through driver sleeve 24 and into depressed bore 104, such axial movement is eliminated, and driver sleeve 24 and spindle 34 become a singly rotating unit. This enhances ease of assembly since driver sleeve 24 can be slid to the proper position with respect to spindle 34 before dropping in pin 36. Toward that end, the preferred embodiment also includes a means for proper axial alignment of the components. According to the preferred embodiment, the driver sleeve bore hole 106 and spindle bore hole 104 will be properly aligned when the detent 96 of the driver sleeve comes into on abutting relation with the terminal point 102 of groove 98 thus substantially simplifying the insertion of connecting pin 36.

Figure 6:
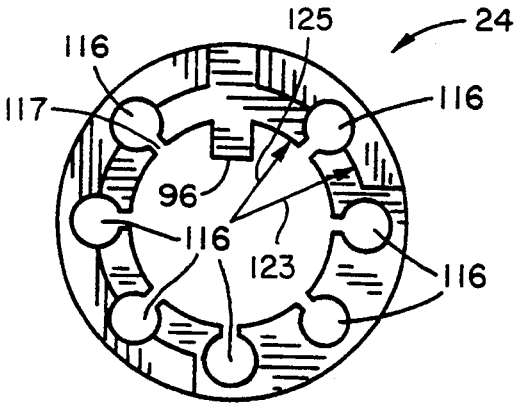
FIG. 6 is a front view of a rotatable driver sleeve for use in the axial pin tumbler lock of the present invention.
Figure 7:
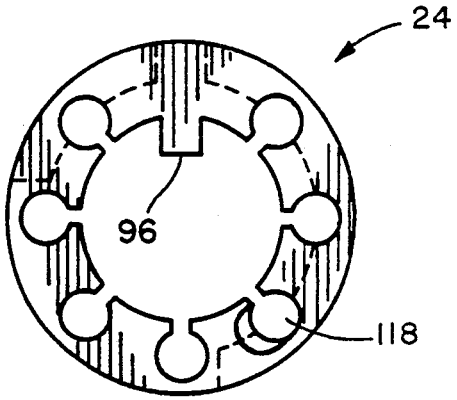
FIG. 7 is a rear view of a rotatable driver sleeve for use in the axial pin tumbler lock of the present invention, and showing the means for achieving the anti-slip function.

To provide for ease of construction and a lower overall lock profile, rotating sleeve 24 has a unique design, shown most clearly in FIGS. 1, 6 and 7. According to the preferred embodiment, rotating sleeve 24 has a birdcage design. A front portion 23 of sleeve 24 has a first, greater diameter, while the rear portion 25 has a second, smaller diameter. These two diameters can be seen in FIG. 6 as designated by reference numerals 123 and 125. The sleeve 24 also includes throughbores 116 arranged circumferentially around the perimeter. In the front portion 23 the throughbores 116 are only semi-circular impressions in the interior wall of sleeve 24 and the driver pins 28 merely rest in these semi-circular portions. In the rear section 25, throughbores 116 are nearly circular, except for a small circumferential area where they communicate with the interior diameter of shell 24. These areas of communication allow sleeve 24 to be investment cast. Because of the configuration of throughbores 116 in the rear section, driver pins 28 are almost completely surrounded by bores 116 thus giving the driver pins 28 greater stability in sleeve 24.

This configuration is beneficial for several reasons. First of all, the need for milling of throughbores in the sleeve is completely eliminated in this design. That is, rotating sleeve 24 can be cast with throughbores 116 already in it, by means of investment casting or the like. The use of investment casting as opposed to traditional die casting also allows for stronger alloys to be used, and for greater tolerances to be achieved. The elimination of milled throughbores, also allows for a smaller lock profile. That is, since throughbores 116 do not need to be completely surrounded by material for support, the outer diameter of shell 24 can be reduced while the inner diameter can be increased. Further, the reduoed overall diameter and increased inner diameter allows for spindle 34 to have a larger diameter, thereby increasing the strength and stability of the lock. At the same time, however, there is no loss in operatability or stability of the lock since the driver pins are still securely held within throughbores 116. The rotating shell 24 also has an advantageous anti-slip feature which will be discussed in greater detail below.

Figure 4:
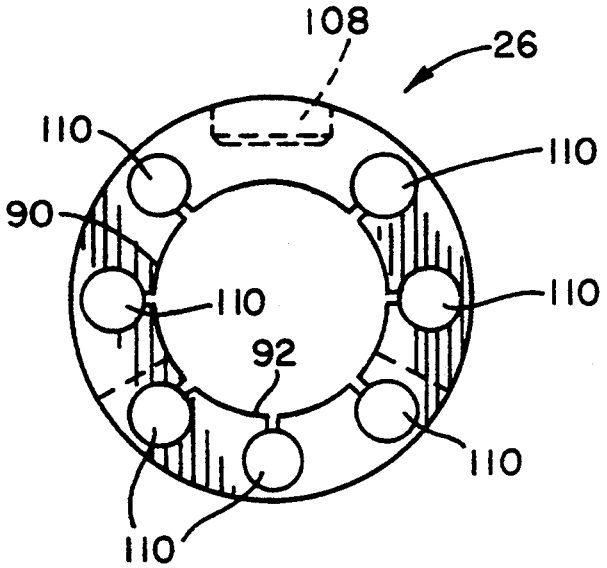
FIG. 4 is a front view of a stationary tumbler sleeve for use in the axial pin tumbler lock of the present invention.
Figure 5:
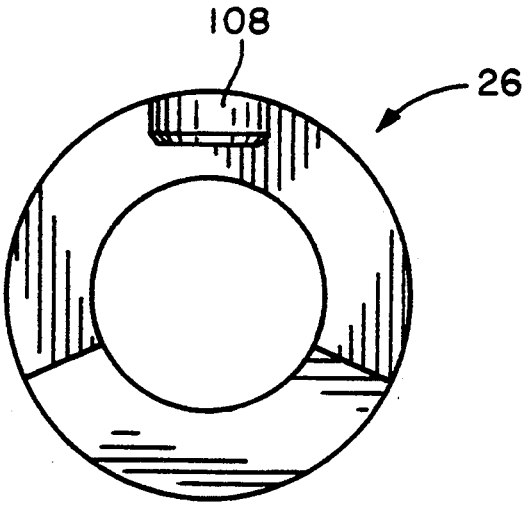
FIG. 5 is a rear view of a stationary tumbler sleeve for use in the axial pin tumbler lock of the present invention.

Stationary tumbler sleeve 26, also has a unique design with similar advantageous features. The stationary tumbler 26 is seen most clearly in the section views of FIGS. 4 and 5. Throughbores 110 are formed in a star-shaped arrangement, and are formed when tumbler sleeve 26 is cast, thus eliminating the need for milling steps. Further the throughbores 110 communicate with the inner diameter of sleeve 26. Similarly, a reduced outer diameter and increased inner diameter is made possible by this design. Stationary sleeve 26 has a diameter 91 that is substantially equal to the outer diameter of the body portion 76 of spindle 34. This allows for tight engagement between the spindle and the stationary sleeve, thus, preventing play between these two components. The ability to use investing casting in forming these components allows greater tolerances to be achieved between the two parts and their interaction at surface 91.

With regard to the actual locking manipulation of driver sleeve 24 and spindle 34, a series of angularly spaced tumbler pins 30 are slideably positioned within bores 110 defined through the non-rotatable tumbler sleeve 26 and function to normally retain the spindle 34 in its locked position wherein rotational movement is prohibited. The tumbler pins 30 are invariably urged forward by means of coiled compression springs 112. These coiled compression springs are disposed within the bores 110 which retain the tumbler pins. Under the urging of the springs 112, the tumbler pins 30 are disposed along the bores 110 in such a manner that the outer ends of the pins normally project outward beyond the sheer plane 114 (FIG. 2) formed at the interface of the tumbler sleeve 26 and the driver sleeve 24 and into corresponding bores 116 defined through the driver sleeve 24. In its normal position, the tumbler pins lock the driver sleeve 24 and connected spindle 34 against rotational movement relative to the tumbler sleeve 26.

However, such relative rotational motion is permitted if the tumbler pins are displaced rearwardly against the urging of the compression springs in such a fashion that the forward ends of all the tumbler pins lie exactly at the sheer plane 114. This rearward displacement of the tumbler pins 30 is affected by driver pins 28 being positioned in an axially slidable manner within the bores 116 of the driver sleeve in such a way that the inner ends of the driver pins engage the outer ends of the corresponding tumbler pins. Generally, at least some of the driver pins are of different lengths so that alignment of all tumbler pins at the sheer plane necessarily requires the displacement of different driver pins by different predetermined distances. This requires the use of a properly coded key 32 to displace the driver pins through the pre-determined distances in order to cause the rear ends of all of the tumbler pins to be simultaneously aligned at the sheer plane so that the spindle 34 may be rotated. Coding of such conventional tumbler locks is accomplished by placing driver pins 28 of varying lengths inside pre-determined bores 116 located in the driver sleeve 24.

To prevent accidental flipping of the lock, which results in undesirable de-coding, an anti-flip groove 118 is included in rotating tumbler sleeve 24, as shown in FIG. 7. The purpose of anti-flip groove 118 is to prevent slight misalignment of the pins 28 and 30 from causing flipping of the lock when the key 32 is withdrawn. Without anti-flip groove 118, slight misalignment of sleeves 24 and 26 could result in all of the tumbler pins 28 resting on the rear face of rotating tumbler 24 when the key is withdrawn. Since the pins rest on the surface, they never cross sheer plane 114 (FIG. 2) and engage in corresponding bores 116 to prevent rotation of stationary sleeve 26. As a result, it would be possible for stationary sleeve 26 to rotate with respect to sleeve 24 in such a way that tumbler pins 28 would cross the sheer plane into the improper throughbores 116 in the rotating tumbler sleeve 24. The result would be that insertion of the key would not properly push all the tumbler pins 28 back to the sheer plane 114 and allow the lock to be unlocked.

To prevent such flipping from occurring, anti-flip groove 118 provides an additional surface area for the tumbler pin 30 associated with that throughbore to engage. That is, in the case of a slight misalignment between sleeve 24 and sleeve 26, the tumbler pin 30 associated with groove 118 would not rest on the rear face of sleeve 24 (the sheer plane 114) but rather would advance beyond that sheer plane and engage with extended groove 118. When this occurs, and the key is withdrawn with the sleeves improperly aligned, rotation of sleeve 26 with respect to sleeve 24, and flipping of the lock, will not occur. If the pin 30 in question is moved in a clockwise sense according to FIG. 7, coil spring 112 would simply push it into engagement with throughbore 118 when they are aligned. If clockwise rotation in the sense of FIG. 7 is attempted, the engagement of the pin 30 with the sidewall of groove 118 will prevent such rotation. Thus, by means of the anti-flip groove 118 misalignment of the sleeves 24, 26 results either in proper realignment of the throughbores, or at the worse, maintains the improperly aligned position while preventing flip. Illustratively, groove 118 might have a depth of 0.02 inches. Further, although groove 118 is shown only on one side of groove 116, one skilled in the art will appreciate that the groove could also be disponed on the other side of bore 116. Use of such grooves on more than one bore 116 is also possible.

Figure 8:
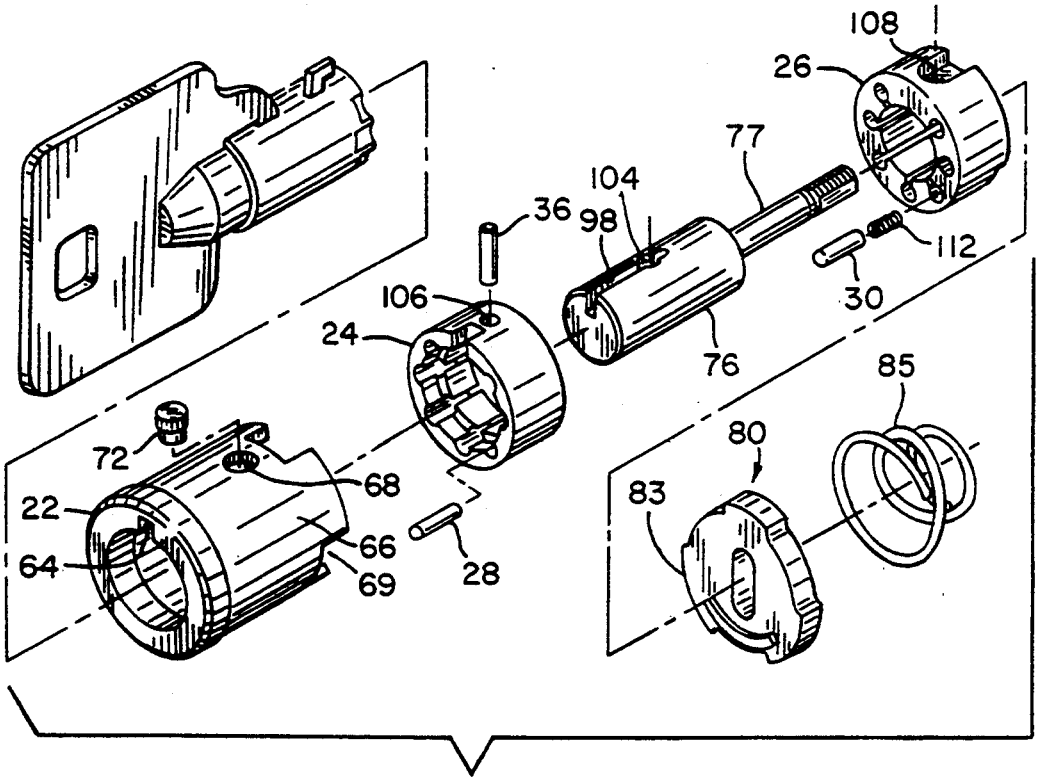
FIG. 8 is an exploded perspective view of an axial pin tumbler lock according to another embodiment of the present invention.

In another embodiment of the present invention, provision is made for the situation where the body of the lock is biased away from the surface being secured. An example of such a situation is where the axial pin tumbler lock 10 is securing a door to a wall. In such a situation, the wall would have an opening for receiving the cam in the unlocked position. Once the cam is through this opening, it would be rotated to the locked position. At that point, it would be desirable for the cam to be biased against the inner surface of the wall, to hold the lock and the door in tight securement. This would be achieved by biasing the internal components of the lock away from the wall. To enhance this biasing, there is included a support plate 80 shown in FIG. 8. Retaining plate 80 has an external geometry which include projections 83 which engage in the splined rear portion 69 in adapted shell 22. As all the other features of shell 22 are the same as in the previous embodiment, similar reference numbers have been used as is the case with the remaining components of lock 10. The interaction of projections 83 and splined geometry 69 ensures that the retaining plate 80 rotates with shell 22. This eliminates the potential for rotational manipulation of the lock during operation. To provide the necessary biasing, a compression spring 85 is provided between retaining plate 80 and the inner surface of the outer shell (not shown) in which the components of the present lock are housed. The slot 108 in tumbler sleeve 26 gives the interior components of the lock the freedom of axial movement required for such biasing.

As can be seen by the foregoing detailed description, this invention provides an improved axial pin tumbler lock having several advantageous features. Among those advantageous features is a low profile as provided by the bird cage and the star shape design of the rotating and stationary tumbler sleeves, respectively. Further, this design of the tumbler sleeves also allows for investment casting of those and other components. The spindle 34 has an advantageous design including a gradual transition region which spreads the forces over a larger area. The rotating tumbler is also provided with an anti-flip groove to prevent accidental flipping and de-coding of the lock. When the lock is biased away from the object being secured, it also includes the advantageous feature of a support-plate which engages a splined inner shell, and a compression spring for providing such biasing. Overall, the lock is highly reliable and yet inexpensive to manufacture and easy to assemble.

What is claimed is:

1. An axial pin tumbler lock comprising in combination:

a shell;

a rotatable driver sleeve telescoped into a forward portion of said shell, the driver sleeve having a front section with a first, larger inner diameter and a rear section with a second, smaller inner diameter and cast throughbores in communication with said diameters;

a stationary tumbler sleeve telescoped into said shell and disposed rearward of said driver sleeve in face-to-face relation with a rear end of said driver sleeve, the tumbler sleeve including cast throughbores in communication with an inner diameter of said tumbler sleeve;

a locking spindle extending through, and rotatably mounted in, the tumbler sleeve, said spindle including a body portion, a neck portion and an actuation portion, the neck portion having a diameter smaller than the diameter of the body portion, the transition zone between the body portion and the neck portion having a curved surface; and driver and tumbler pins slidably mounted in the throughbores of the tumbler and driver sleeves and normally operable to prevent rotation of said spindle with respect to the stationary driver sleeve.

2. An axial pin tumbler lock according to claim 1, wherein said rotatable driver sleeve includes an internally disposed detent and said spindle includes a longitudinal groove in said body portion for receiving said detent.

3. An axial pin tumbler lock according to claim 2, wherein axial movement of said spindle relative to said driver sleeve is limited through the engagement of the driver sleeve detent and the longitudinal spindle groove.

4. An axial pin tumbler lock according to claim 3, wherein said driver sleeve includes a radial throughbore and said longitudinal groove in the spindle includes a complemental radial throughbore and a connecting pin is disposed within the radial throughbores for translating the rotational movement of the driver sleeve to the spindle.

5. An axial pin tumbler lock according to claim 1, wherein the tumbler sleeve is retained in locked engagement with the shell by a cooperating pin and slot, the slot being disposed on the outer perimeter of the tumbler sleeve, and the pin being disposed through the shell and engaging the slot.

6. An axial pin tumbler lock according to claim 1, wherein the tumbler sleeve has an inner diameter substantially equal to the outer diameter of the body portion of the spindle, and said inner diameter providing support to said spindle.

7. An axial pin tumbler lock according to claim 1, wherein at least one of the cast throughbores in the driver sleeve includes an anti-flip groove, said anti-flip groove being a shallow depression in the rear face of the driver sleeve, and being adjacent to and in communication with one of said cast throughbores such that a misaligned tumbler pin will engage the anti-flip groove to prevent flip and decoding of the lock.

8. An axial pin tumbler lock comprising in combination:

a shell;

a rotatable driver sleeve telescoped into a forward portion of said shell, the driver sleeve having a front section with a first, larger inner diameter and a rear section with a second, smaller inner diameter and cast throughbores in communication with said diameters;

a stationary tumbler sleeve telescoped into said shell and disposed rearward of said driver sleeve in face-to-face relation with a rear end of said driver sleeve, the tumbler sleeve including cast throughbores in communication with an inner diameter of said tumbler sleeve;

a locking spindle extending through, and rotatably mounted in, the tumbler sleeve, said spindle including body portion, a neck portion and an actuation portion, the neck portion having a diameter smaller than the diameter of the body portion, the transition zone between the body portion and the neck portion having a curved surface; and driver and tumbler pins slidably mounted in the cast throughbores of the tumbler and driver sleeves and normally operable to prevent rotation of said spindle with respect to the stationary tumbler sleeve; and a retaining plate disposed in face-to-face relation with the rearward face of the tumbler sleeve, the face-to-face relation being maintained by spring means disposed rearwardly of the retaining plate.

9. An axial pin tumbler lock according to claim 8, wherein said rotatable driver sleeve includes an internally disposed detent and said spindle includes a longitudinal groove in said body portion for receiving said detent.

10. An axial pin tumbler lock according to claim 9, wherein axial movement of said spindle relative to said driver sleeve is limited through the engagement of the driver sleeve detent and the longitudinal spindle groove.

11. An axial pin tumbler lock according to claim 10, wherein said driver sleeve includes a radial throughbore and said longitudinal groove in the spindle includes a complemental radial throughbore and a connecting pin is disposed within the radial throughbores for translating the rotational movement of the driver sleeve to the spindle.

12. An axial pin tumbler lock according to claim 8, wherein the tumbler sleeve is retained in locked engagement with the shell by a cooperating pin and slot, the slot being disposed on the outer perimeter of the tumbler sleeve, and the pin being disposed through the shell and engaging the slot.

13. An axial pin tumbler lock according to claim 8, wherein the tumbler sleeve has an inner diameter substantially equal to the outer diameter of the body portion of the spindle, and said inner diameter providing support to said spindle.

14. An axial pin tumbler lock according to claim 8, wherein at least one of the cast throughbores in the driver sleeve includes an anti-flip groove, said anti-flip groove being a shallow depression in the rear face of the driver sleeve, and being adjacent to and in communication with one of said cast throughbores such that a misaligned tumbler pin will engage the anti-flip groove to prevent flip and decoding of the lock.

15. An axial pin tumbler lock according to claim 8, wherein the rear portion of said shell is of a splined configuration and wherein the perimeter of the retaining plate has a geometry including projections which cooperatively engage the splined configuration precluding rotation of the retaining plate with respect to the shell.

* * * * *